US005566412A

United States Patent [19]

Arnold

[11] Patent Number: 5,566,412

[45] Date of Patent: Oct. 22, 1996

[54] INCLINABLE BED FRAME ASSEMBLY

[76] Inventor: George M. Arnold, 2627 Hwy. 14, Lake Charles, La. 70601

[21] Appl. No.: 404,928

[22] Filed: Mar. 16, 1995

[51] Int. Cl.[6] ..... A47C 19/04

[52] U.S. Cl. ..... 5/610; 5/509.1

[58] Field of Search ..... 5/509.1, 610, 616, 5/617

[56] References Cited

U.S. PATENT DOCUMENTS

| | | | |
|---|---|---|---|
| 352,941 | 11/1886 | Winter | 5/617 |
| 2,887,691 | 5/1959 | Talarico et al. | 5/610 |
| 3,866,251 | 2/1975 | Pounds | 5/624 |
| 4,376,316 | 3/1983 | Mercier et al. | 5/616 |
| 4,625,348 | 12/1986 | Renggli et al. . | |
| 4,715,073 | 12/1987 | Butler . | |
| 4,807,313 | 2/1989 | Ryder et al. . | |
| 4,856,129 | 8/1989 | Butler . | |
| 4,893,365 | 1/1990 | Justice . | |
| 4,928,332 | 5/1990 | Ogden et al. . | |
| 5,020,169 | 6/1991 | Hamada et al. . | |
| 5,105,486 | 4/1992 | Peterson . | |
| 5,134,731 | 8/1992 | Quintile et al. . | |
| 5,136,742 | 8/1992 | Stebbins et al. . | |
| 5,243,726 | 9/1993 | Bisbee | 5/610 |
| 5,410,768 | 5/1995 | Manson et al. | 5/509.1 |

*Primary Examiner*—Lloyd A. Gall
*Assistant Examiner*—Robert G. Santos
*Attorney, Agent, or Firm*—Robert N. Montgomery

[57] ABSTRACT

An inclinable bed frame assembly is provided which permits one to adjust the angular disposition of the mattress between a first horizontal position and an inclined position. The bed frame accommodates conventional, full size mattresses and/or head boards as may be desired. Generally, the improved bed frame is comprised of two frames, one lower or base frame and the other upper or mattress frame. Both frames are configurable to most standard size mattresses. The upper or mattress frame is pivotally connected to the base frame only at its foot end thus allowing the head end of the mattress frame to be raised or lowered as desired via torque arms or screw jack assembly.

10 Claims, 5 Drawing Sheets

INCLINABLE BED FRAME ASSEMBLY

BACKGROUND OF THE INVENTION

1. Field of the Invention

The present invention relates to a bed frame assembly, and more particularly, to an inclinable bed frame wherein the bed's mattress frame can be varied between a horizontal position and an incline position.

2. Brief Description of the Prior Art

Physicians who treat patients who suffer with heart burn (Stomach acid back-up) and other such digestive disorders often recommend that the patient not recline in a true horizontal position but rather in an incline one. To achieve this the patient resorts to various methods of adjusting his home bedstead and its mattress in a manner which raises the head end a few inches, usually 4–6 inches, higher that the foot. Although the desired incline may be achieved in this manner, the bedstead is often unstable and unsightly.

To overcome the above problems, several adjustable bed arrangements have been developed which allow for incremental adjustment by pining or by infinite positioning by a remote, manual or electric control system. Examples of such technology can be seen in U.S. Pat. Nos. 4,625,348; 4,928,332; 5,136,742; and 5,105,486. Even sloping or inflatable mattresses have been developed to provide the head-up incline as disclosed in U.S. Pat. No. 4,807,313. Special mattresses are also expensive, as would be the case with such technology as disclosed in U.S. Pat. No. 4,893,365. Most such beds have been developed for use by patients who are confined to a bed for extensive periods of time. These beds must accommodate various positions such as raising the foot or head portions and/or raising the entire bed frame, as seen in U.S. Pat. No. 5,020,169 again increasing cost.

As a result of the above problems, attempts have been made to utilize standard bed frames by raising one end of a mattress by extending the headboard legs as disclosed by U.S. Pat. No. 5,134,731. These problems have been addressed by Butler in U.S. Pat. Nos. 4,715,073 and 4,856,129. However, Butler's apparatus is far too complicated and expensive, considering what it achieves. The prior art agrees, there is a need for an improved inclinable bed frame assembly which accommodates a standard, queen or king size mattress with reduced weight and simplified construction which reduces cost. It is to such an end that the present invention is directed.

SUMMARY OF THE PRESENT INVENTION

The present invention is an improved, inclinable bed frame assembly which permits one to adjust the angular disposition of a mattress between a first, horizontal position and an inclined position. The bed frame accommodates conventional mattresses and/or head boards as may be desired. Generally, the improved bed frame is comprised of two frames, one lower or base frame and the other upper or mattress frame. Both frames are configurable to most standard size mattresses. The upper or mattress frame is pivotally connected to the base frame at its foot end thus allowing the head end of the mattress frame to be raised or lowered as desired. An electric jack screw arrangement is provided which cooperates with a bell crank assembly for elevating the mattress frame. As a result fewer moving parts are required, thereby reducing weight and cost. It is, therefore, an object of the present invention to provide an improved, inclinable bed frame assembly for use with conventional mattresses wherein the angular disposition of the mattress may be selectively moved between a horizontal position and an incline position.

Another object of the present invention is to provide an improved, inclinable, bed frame assembly which can be attached to a conventional headboard.

Yet another object of the present invention is to provide an inclinable bed frame which has the appearance of a conventional bed.

Still another object of the present invention is to provide an inclinable bed frame which is durable in construction, economical to manufacture and easy to maintain with a minimum of moving parts. These and other objects and advantages shall become apparent to those skilled in the art by reading the detailed description taken in conjunction with the drawings appended hereto.

BRIEF DESCRIPTION OF THE DRAWINGS

The illustrated embodiment of the present invention will now be described in greater detail with reference to the accompanying drawings. In this regard the enclosed drawings illustrate a preferred form of the invention and are not to be considered as limiting with respect thereto.

DETAILED DESCRIPTION OF THE PREFERRED EMBODIMENT

Figure 1:
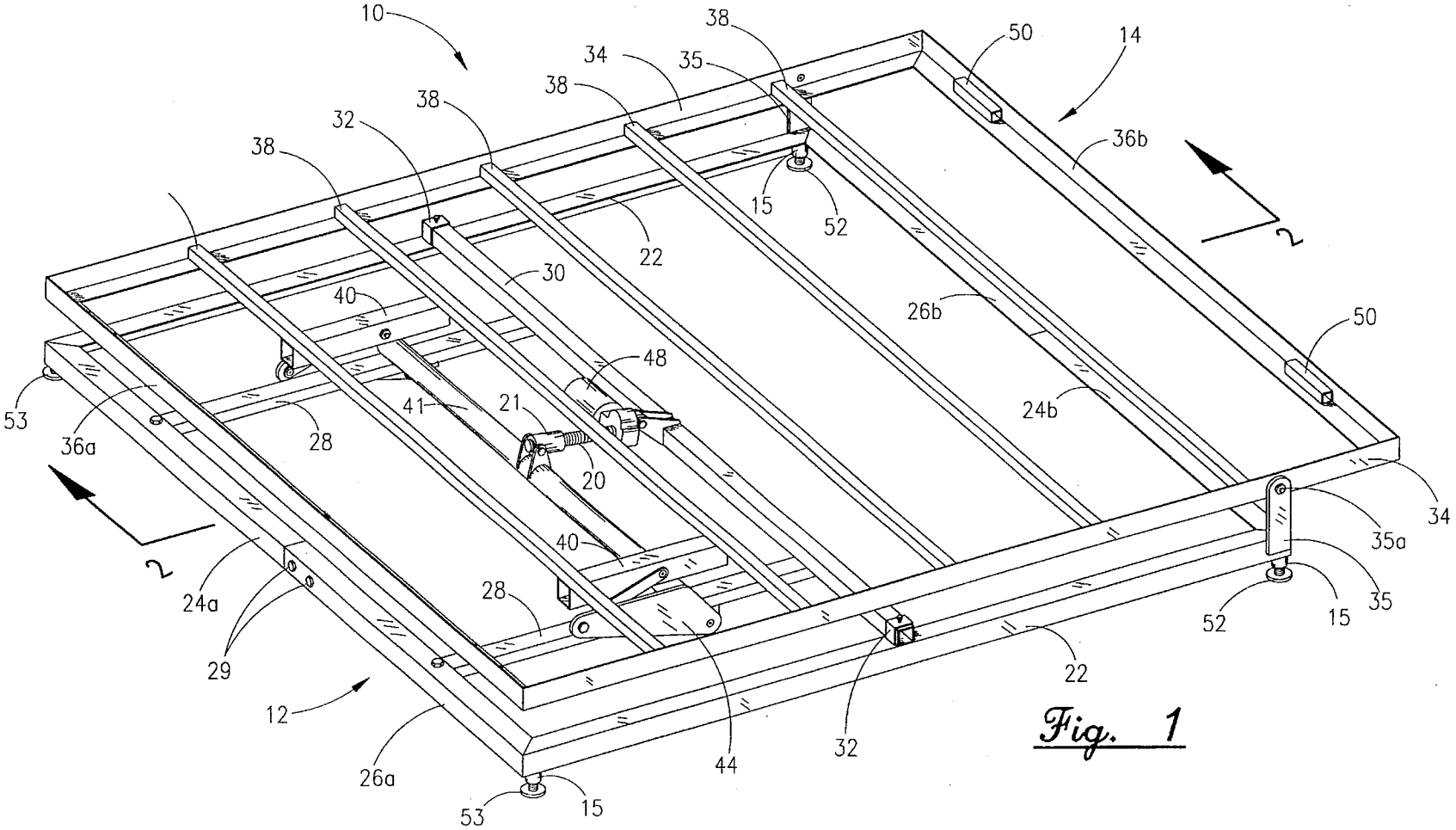
FIG. 1 is an isometric illustration of the inclinable base and mattress frame assembly utilizing a screw jack and torque arm arrangement.

Referring now to the drawings and more particularly to FIG. 1 shown therein is an inclinable bed frame assembly 10 constructed of suitable, structural shapes. The improved inclinable bed frame assembly 10 comprises a base frame 12 and a mattress frame 14 pivotally supported by the base frame 12 in a manner whereby the mattress frame 14 can be infinitely positioned, in an incline plane relative to the base frame 12, limited only by the length of the rotary actuator lead screw 20 seen in FIG. 3. The base frame 12 is a generally rectangular shaped configuration formed of a plurality of elongated, structural, angle shaped members 22, 24, 26, which are interconnected so that the base frame 12 has opposed, spatially disposed side 22, head **24*a*, 26*a* and foot 24*b*, 26*b* rails. The frame may also be disassembled for transport and storage by removing bolts 29 located at the head and foot rails 26*a*, 26*b* removing the actuator cross member 30 from clevis attachments 32 and unbolting the actuator frame members 28 from the head rail 24*a*, 26*a* members. The actuator frame assembly, comprising the actuator cross member 30 and the actuator frame truss members 28 and its associated toggle and linkage assembly, comprising the torque bar 41 and toggle link 42 can be further separated from the mattress frame 14 by disconnecting the toggle link 42 from the bridge members 40. The base frame 12 may be constructed utilizing structural channel members with sufficient depth to allow the pivot brackets 46 to clear a support surface thus making support legs unnecessary. However, the frame may be supported by leg hubs 15 or on relatively short, adjustable legs 52, 53** located near each corner, or they can also be fitted with rollers if desired.

The mattress frame 14, somewhat longer than the base frame 12, is comprised of a generally rectangular shaped configuration, formed from a plurality of elongated, structural, angle shaped members interconnected so that the frame 14 has opposed, spatially disposed side rails 34, head rails 36*a* and foot rails 36*b*. In some cases it may also be desirable to disassembled the mattress frame 14 for transport and storage in which case corner brackets or sectionally separated similar to that of the base frame 12. In such case, the slat rails 38 would be bolted to the side rails 34. It should also be noted that by having a sectional frame extensions may be used to convert a standard, double bed to a queen or king size frame. The mattress frame 14 supportingly receives a conventional mattress and box spring in which case a footboard (not shown) may be bolted to the foot rail 36*b*. The mattress frame 4 would be factory sized to fit odd sizes as well. The base frame 2 and mattress frame 4 would be expandable constructed to fit single, twin, queen or king size mattresses and box spring mattress sets. A plurality of cross members or slat rails 38 perpendicular to the side rails 34 of the mattress frame 4, add additional rigidity and support for the mattress and box frame sets as well as provide support for the bridge members 40. Spacers 50 also provide additional support at each end. Attachment of the base frame 12 to a headboard (not shown) can be achieved in a conventional manner, with headboard brackets fastened to the head rail 24*a*, 26*a* of the base frame 12. Since virtually any headboard can be adapted to the base frame 12, a detailed description of this process is not deemed necessary.

Figure 2:
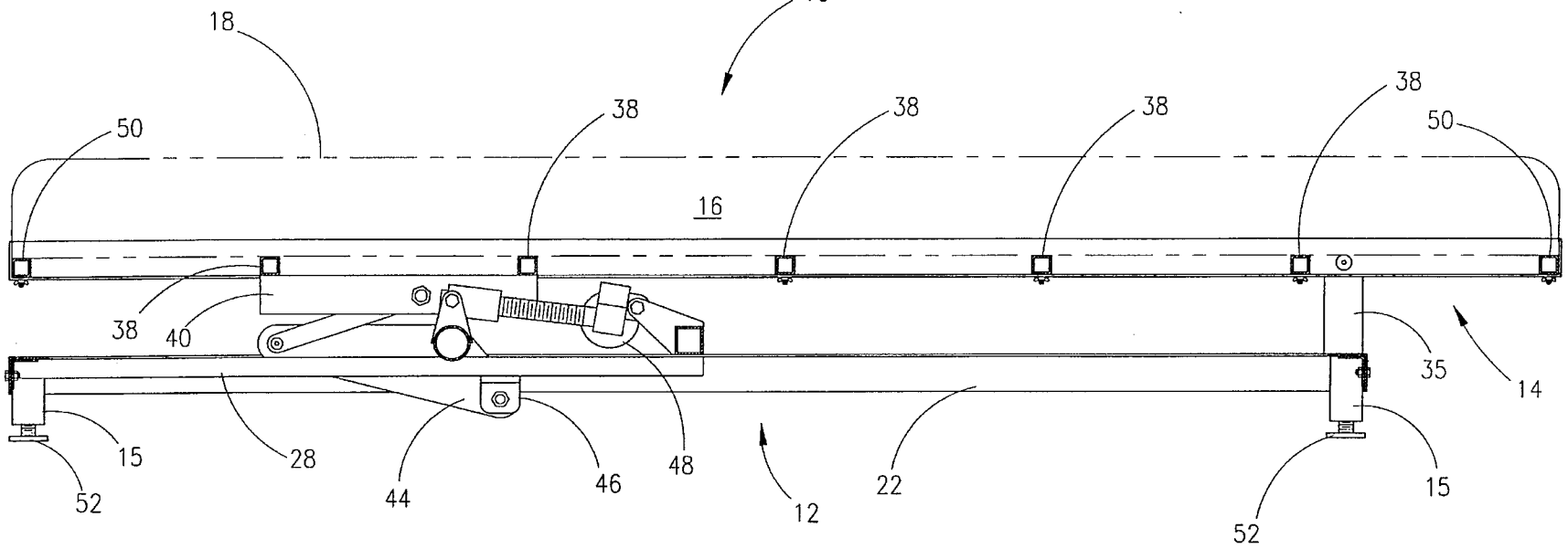
FIG. 2 is a cross section view taken along sight line 2—2 in FIG. 1.
Figure 3:
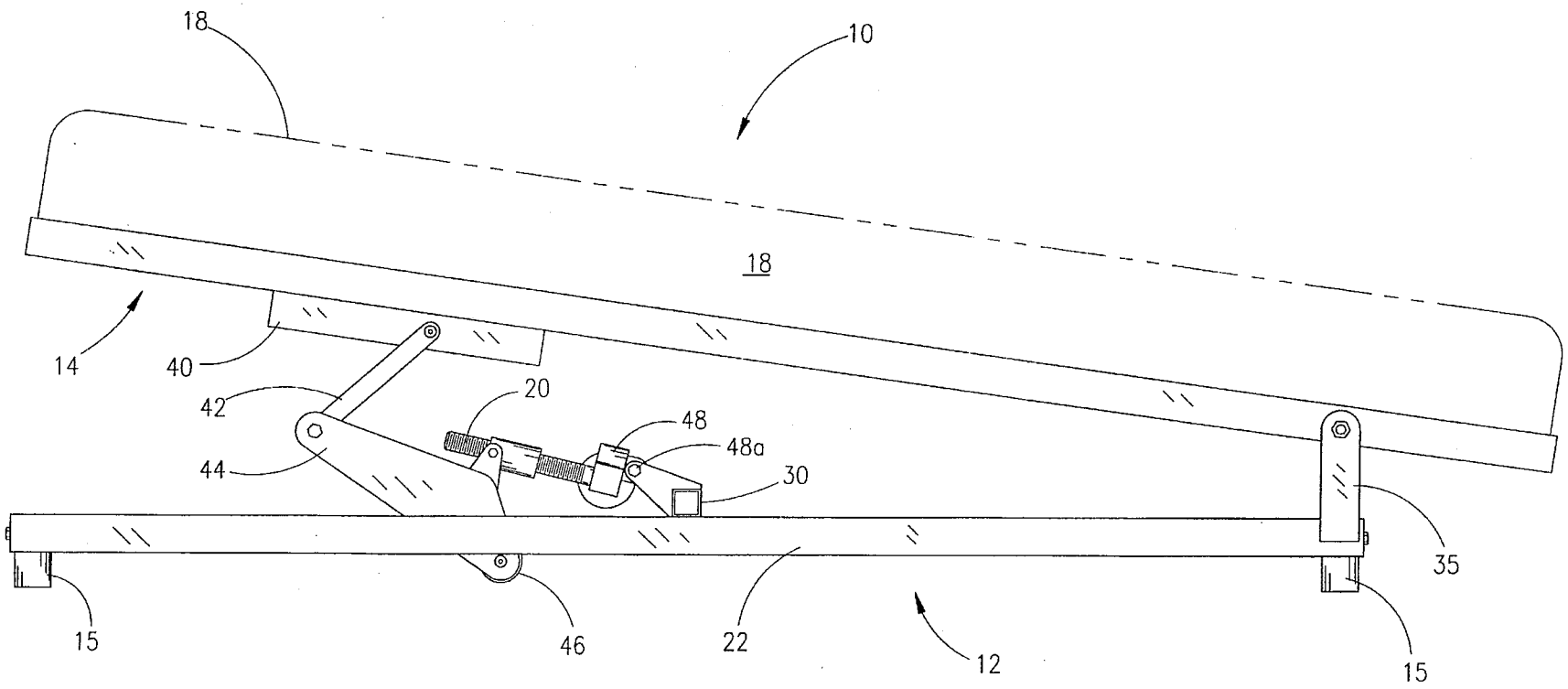
FIG. 3 is a side elevation of the inclinable bed frame assembly shown in FIG. 1 but in the incline position.

Support for the mattress frame 4 is provided by pivotally supporting the foot end relative to the base frame 12, via the foot post members 35 located adjacent the support legs 52, which project upwards slightly above the base frame side rails 22 thus allowing the head end 16 of the mattress 8 to move freely between the substantially horizontally disposed position seen in FIG. 2 and the inclined angular position as seen in FIG. 3. The pivot post members 35 are rigidly connected to the elongated side rail members 22 near the foot end rails 24*b*, 26*b* at or near the support legs 52 so that the post members 35 are aligned one with the other and are pivotally connected to the elongated side rail members 34 of the mattress frame 14 as shown in FIG. 1–3. It should be noted that the mattress frame 14 overhangs the base frame 12 at the foot end 36*b* to prevent contact between the two frames 12, 14 when the mattress frame 14 is moved to the fully inclined position. To move the mattress frame 14 from the horizontal position in FIG. 2 to an incline position as in FIG. 3, the electric drive or gear motor 48 is activated remotely. The lead screw 20 in cooperation with the lead screw nut 21 which is pivotally connected to the torque bar 41, then rotates in a forward or reverse direction thus pivoting the torque arms 44 which in turn lift the mattress frame 14 via the toggle link 42 connecting the torque arm 44 to the bridge members 40. Moving parts are thereby reduced to only ten pivot points comprised of each end of the toggle link 42, the torque arm pivot point 46, the lead screw nut 21, actuator pivot points 48*a*, and the mattress frame pivot point 35*a*.

Figure 4:
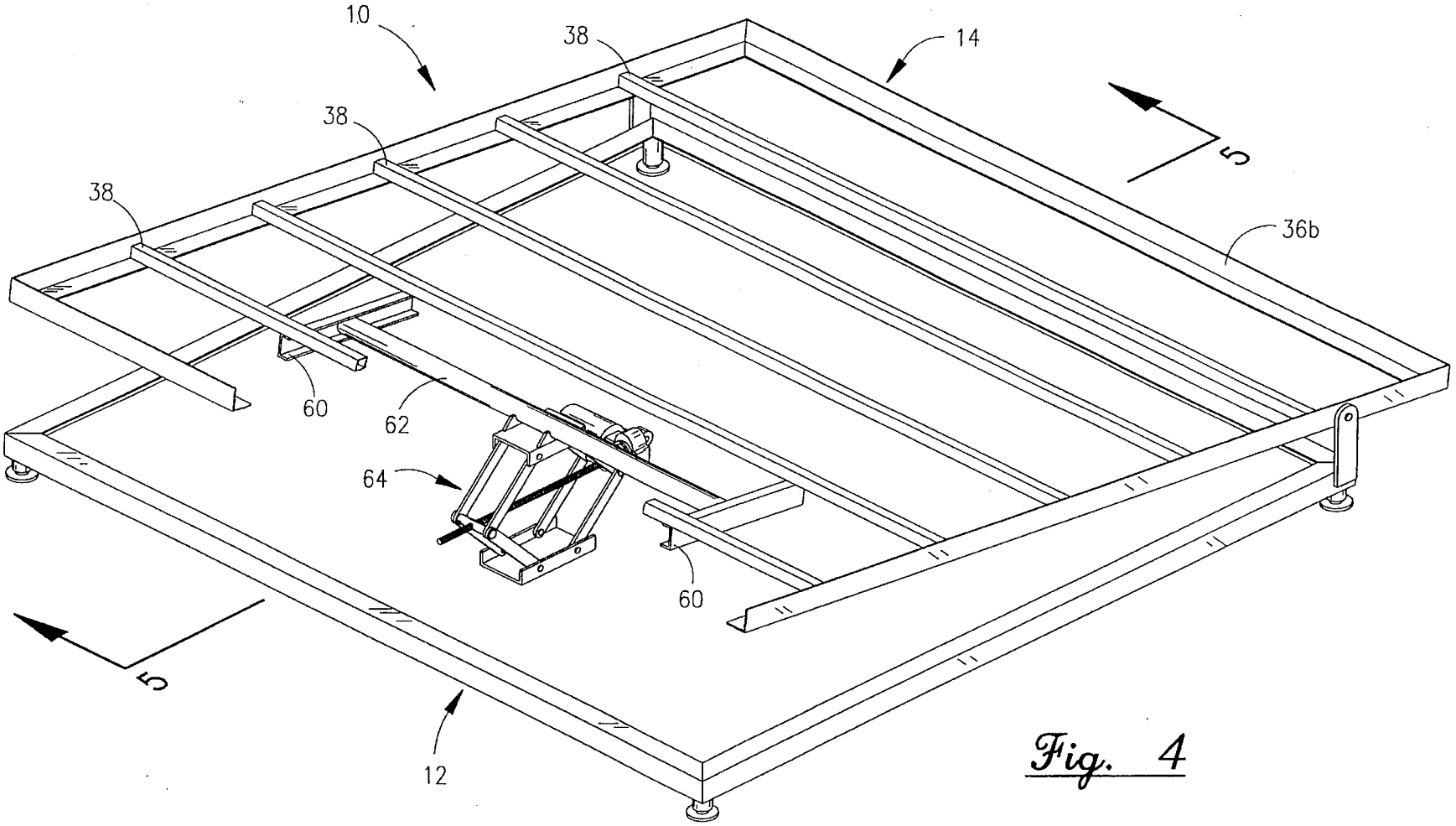
FIG. 4 is a partial isometric view of the inclinable bed in the raised position utilizing a second embodiment for lifting with a screw jack arrangement.
Figure 5:
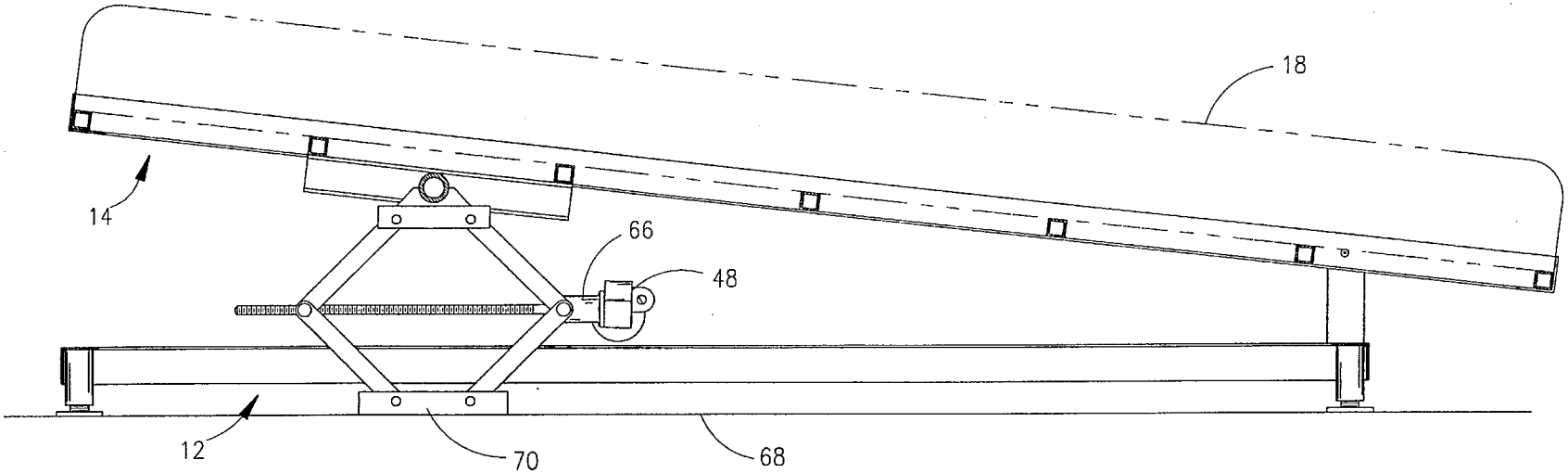
FIG. 5 is a cross section elevation view taken along the sight line 3—3 in FIG. 4 of the inclinable bed utilizing a screw jack arrangement.

A second embodiment as depicted in FIGS. 4 & 5 show how the bed frame 14 may be elevated by utilizing a simple scissor jack assembly 64. By adapting the electric drive or gear motor 48 to the coupling 66, the jack assembly 64 can be suspended from bar 62. Trave 62 is free to slide in channels 60 thus allowing both trave 62 and jack assembly 64 to seek equilibrium relative to the bed support surface 68. When the jack assemble 64 is collapsed the jack base plate 70 is suspended above the bed support surface 68. When the electric drive or gear motor 48 is activated the base plate 70 comes in contact with the support surface 68 and thus the jack extends upwards raising frame 14 relative to frame 12.

From the above description, it is evident that the improved inclinable bed frame assembly 10 drastically reduces cost by simplifying construction and the number of moving parts. While the preferred embodiment has been disclosed herein, it should be understood that numerous changes may be made by those skilled in the art while remaining within the scope of the disclosure and the appended claims.

What is claimed is:

1. An inclinable bed frame assembly comprising:

A) a base frame comprising:

a) a plurality of elongated members having approximately equal cross section, interconnected to provide a substantially rectangular shaped main frame with opposed, spatially disposed side head and end rails;

b) a detachable actuator cross member having a clevis attachment;

c) a pair of truss attached perpendicular to said acuator cross member extending parallel to said side rails and further detachably connected to said head rail;

d) a post member attached to each side rail adjacent said end rail extending above said base frame side rails;

e) an adjustable leg extending downward from each corner of said rectangular base frame;

B) a mattress frame pivotally attached to said post member comprising:

a) a plurality of elongated members having approximately equal cross section interconnected to provide a substantially rectangular shaped mattress frame with opposed, spatially disposed side, head and end rails, said frame being longer than said base frame;

b) a plurality of slat members perpendicular to said spatially disposed side rails;

c) a pair of bridge members being intermediately disposed below and attached to at least two of said slat members; and C. a toggle means located intermediate said base frame and said mattress frame for pivotally lifting said mattress frame relative to said base frame comprising:

a) a torque bar having a clevis attachment and torque arms fixedly attached at each end, said torque arms being pivotally attached to said truss;

b) a toggle link pivotally attached to each said torque arm and to said bridge member, in a manner whereby said torque bar rest on said truss; and c) a positioning means for rotating said torque arms at an incline relative to said base frame, pivotally attached to said actuator cross member and torque bar clevis.

2. The inclinable bed frame assembly according to claim 1 wherein said base frame may be disassembled for transport.

3. The inclinable bed frame assembly according to claim 1 wherein said mattress frame further comprises spacer members disposed along inside edge of said head and end rails equal to that of said slat height.

4. The inclinable bed frame assembly according to claim 3 wherein said mattress frame slats are fixed to said side rails and not removable.

5. The inclinable bed frame assembly according to claim 1 wherein said positioning means is a electric drive.

6. An inclinable bed frame assembly comprising:

A) a base frame comprising:

a) a plurality of elongated members having approximately equal cross section, interconnected to provide a substantially rectangular shaped main frame with opposed, spatially disposed side head and end rails;

b) a detachable actuator cross member having a clevis attachment;

c) a pair of truss attached perpendicular to said acuator cross member extending parallel to said side rails and further detachably connected to said head rail;

d) a post member attached to each side rail adjacent said end rail extending above said base frame side rails;

e) an adjustable leg extending downward from each corner of said tangular base frame;

B) a mattress frame pivotally attached to said post member comprising:

a) a plurality of elongated members having approximately equal cross section interconnected to provide a substantially rectangular shaped mattress frame with opposed, spatially disposed side, head and end rails, said frame being longer than said base frame;

b) a plurality of slat members perpendicular to said spatially disposed side rails;

c) a pair of bridge members being intermediately disposed below, and attached to at least two of said slat members; and C. a toggle means located between said base frame and said mattress frame for pivotally lifting said mattress frame relative to said base frame comprising:

a) a torque bar having a clevis attachment and torque arms fixedly attached at each end, said torque arms being pivotally attached to said truss;

b) a toggle link pivotally attached to each said torque arm and to said bridge member, in a manner whereby said torque bar rest on said truss;

c) a positioning means for rotating said torque arms at an incline relative to said base frame, pivotally attached to said acuator cross member and torque bar clevis; and d) an electric drive means attached to said positioning means for selectively raising and lowering said mattress frame relative to said base frame.

7. The inclinable bed frame assembly according to claim 6 wherein said electric drive is remotely controlled.

8. The inclinable bed frame assembly according to claim 6 wherein said positioning means is a lead screw and nut assembly.

9. The inclinable bed frame assembly according to claim 6 wherein said base frame and said mattress frame may be interposed into a standard bed frame having head boards, side rails and foot board.

10. An inclinable bed frame assembly comprising:

A) a support surface;

B) a base frame resting on said support surface comprising:

a) a plurality of elongated members having approximately equal cross section, interconnected to provide a substantially rectangular shaped main frame with opposed, spatially disposed side head and end rails;

b) a post member attached to each side rail adjacent said end rail extending above said base frame side rails; and c) a leg member extending below said frame, attached to each corner of said rectangular frame;

C) a mattress frame pivotally attached to each said post member comprising:

a) a plurality of elongated members having approximately equal cross section, interconnected to provide a substantially rectangular shaped mattress frame with opposed, spatially disposed side, head and end rails, said mattress frame being longer than said base frame;

b) a plurality of slat members perpendicular to said spatially disposed side rails;

c) a pair of bridge channel members intermediate said slats spanning at least two said slat members nearest said head rail; and D) an elevating means for raising a portion of said mattress frame at an incline relative to said base frame comprising:

a) a trave in slidable engagement with said bridge channel members;

b) a scissor jack having a lifting bar and a base whereby said lifting bar is attached intermediate said trave, with said base in contact with said base frame support surface; and c) an electric gear motor close coupled to said scissor jack for selectively positioning said mattress frame at an incline relative to said base frame.

* * * * *